US007320505B1

(12) United States Patent
Hall et al.

(10) Patent No.: US 7,320,505 B1
(45) Date of Patent: Jan. 22, 2008

(54) ATTACK TOOL

(76) Inventors: David R. Hall, 2185 S. Larsen Pkwy., Provo, UT (US) 84606; Ronald Crockett, 2185 S. Larsen Pkwy., Provo, UT (US) 84606; Jeff Jepson, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 11/463,990

(22) Filed: Aug. 11, 2006

Related U.S. Application Data

(63) Continuation-in-part of application No. 11/463,975, filed on Aug. 11, 2006, which is a continuation-in-part of application No. 11/463,962, filed on Aug. 11, 2006.

(51) Int. Cl.
*E21C 37/00* (2006.01)

(52) U.S. Cl. ..... 299/105; 299/111

(58) Field of Classification Search ..... 299/105, 299/111

See application file for complete search history.

(56) References Cited

U.S. PATENT DOCUMENTS

| | | | | |
|---|---|---|---|---|
| 2,004,315 | A | | 6/1935 | Fean |
| 2,124,438 | A | | 7/1938 | Struk |
| 3,254,392 | A | | 6/1966 | Novkov |
| 3,746,396 | A | | 7/1973 | Radd |
| 3,807,804 | A | | 4/1974 | Kniff |
| 3,932,952 | A | | 1/1976 | Helton |
| 3,945,681 | A | | 3/1976 | White |
| 4,005,914 | A | | 2/1977 | Newman |
| 4,006,936 | A | | 2/1977 | Crabiel |
| 4,098,362 | A | | 7/1978 | Bonnice |
| 4,109,737 | A | | 8/1978 | Bovenkerk |
| 4,156,329 | A | | 5/1979 | Daniels |
| 4,199,035 | A | | 4/1980 | Thompson |
| 4,201,421 | A | | 5/1980 | Den Besten |
| 4,268,089 | A | | 5/1981 | Spence |
| 4,277,106 | A | * | 7/1981 | Sahley ..... 299/111 |
| 4,439,250 | A | | 3/1984 | Acharya |
| 4,465,221 | A | | 8/1984 | Schmidt |
| 4,484,644 | A | * | 11/1984 | Cook et al. ..... 175/420.1 |
| 4,484,783 | A | | 11/1984 | Emmerich |
| 4,489,986 | A | | 12/1984 | Dziak |
| 4,660,890 | A | | 4/1987 | Mills |
| 4,678,237 | A | | 7/1987 | Collin |
| 4,682,987 | A | * | 7/1987 | Brady et al. ..... 51/293 |
| 4,684,176 | A | | 8/1987 | Den Besten |
| 4,688,856 | A | | 8/1987 | Elfgen |
| 4,725,098 | A | | 2/1988 | Beach |
| 4,728,153 | A | | 3/1988 | Ojanen |
| 4,729,603 | A | | 3/1988 | Elfgen |
| 4,765,686 | A | | 8/1988 | Adams |
| 4,765,687 | A | | 8/1988 | Parrott |
| 4,776,862 | A | | 10/1988 | Wiand |
| 4,836,614 | A | | 6/1989 | Ojanen |
| 4,850,649 | A | | 7/1989 | Beach |
| 4,880,154 | A | | 11/1989 | Tank |

(Continued)

*Primary Examiner*—John Kreck
(74) *Attorney, Agent, or Firm*—Tyson J. Wilde

(57) ABSTRACT

In one aspect of the invention, an attack tool is disclosed which comprises a wear-resistant base suitable for attachment to a driving mechanism. The wear-resistant base has a shank and a metal segment. A cemented metal carbide segment is bonded to the metal segment and the shank has a wear-resistant surface. The wear-resistant surface has a hardness greater than 60 HRc.

20 Claims, 17 Drawing Sheets

U.S. PATENT DOCUMENTS 4,921,310 A 5/1990 Hedlund
4,932,723 A 6/1990 Mills
4,940,288 A 7/1990 Stiffler
4,944,559 A * 7/1990 Sionnet et al. ..... 299/105
4,951,762 A 8/1990 Lundell
5,007,685 A 4/1991 Beach
5,011,515 A 4/1991 Frushour
5,112,165 A 5/1992 Hedlund
5,141,289 A 8/1992 Stiffler
5,154,245 A 10/1992 Waldenstrom
5,186,892 A 2/1993 Pope
5,251,964 A 10/1993 Ojanen
5,303,984 A 4/1994 Ojanen
5,332,348 A 7/1994 Lemelson
5,415,462 A 5/1995 Massa
5,417,475 A 5/1995 Graham
5,447,208 A 9/1995 Lund
5,503,463 A 4/1996 Ojanen
5,535,839 A 7/1996 Brady
5,542,993 A 8/1996 Rabinkin
5,653,300 A 8/1997 Lund
5,720,528 A 2/1998 Ritchey
5,725,283 A 3/1998 O'Neill
5,730,502 A 3/1998 Montgemery
5,738,698 A 4/1998 Kapoor
5,823,632 A 10/1998 Burkett
5,837,071 A 11/1998 Anderson
5,845,547 A 12/1998 Sollami
5,875,862 A 3/1999 Jurewicz
5,884,979 A 3/1999 Latham
5,934,542 A 8/1999 Nakamura
5,935,718 A 8/1999 Demo
5,944,129 A 8/1999 Jenson
5,967,250 A 10/1999 Lund
5,992,405 A 11/1999 Sollami
6,006,846 A 12/1999 Tibbitts
6,019,434 A 2/2000 Emmerich
6,044,920 A 4/2000 Massa
6,051,079 A 4/2000 Andersson
6,056,911 A 5/2000 Griffin
6,065,552 A 5/2000 Scott
6,113,195 A 9/2000 Mercier
6,170,917 B1 1/2001 Heinrich
6,193,770 B1 2/2001 Sung
6,196,636 B1 3/2001 Mills
6,196,910 B1 3/2001 Johnson
6,199,956 B1 3/2001 Kammerer
6,216,805 B1 4/2001 Lays
6,270,165 B1 8/2001 Peay
6,341,823 B1 1/2002 Sollami
6,354,771 B1 3/2002 Bauschulte
6,357,832 B1 3/2002 Sollami
6,364,420 B1 4/2002 Sollami
6,371,567 B1 4/2002 Sollami
6,375,272 B1 4/2002 Ojanen
6,419,278 B1 7/2002 Cunningham
6,478,383 B1 11/2002 Ojanen
6,481,803 B2 11/2002 Ritchey
6,499,547 B2 12/2002 Scott
6,508,516 B1 1/2003 Kammerer
6,517,902 B2 2/2003 Drake
6,585,326 B2 7/2003 Sollami
6,644,755 B1 11/2003 Kammerer
6,685,273 B1 2/2004 Sollami
6,692,083 B2 2/2004 Latham
6,702,393 B2 3/2004 Merceir
6,709,065 B2 3/2004 Peay
6,719,074 B2 4/2004 Tsuda
6,733,087 B2 * 5/2004 Hall et al. ..... 299/113
6,739,327 B2 5/2004 Sollami
6,758,530 B2 7/2004 Sollami
6,786,557 B2 9/2004 Montgomery
6,824,225 B2 11/2004 Stiffler
6,851,758 B2 2/2005 Beach
6,854,810 B2 2/2005 Montgomery
6,861,137 B2 3/2005 Griffin
6,889,890 B2 5/2005 Yamazaki
6,962,395 B2 11/2005 Mouthaan
6,966,611 B1 11/2005 Sollami
6,994,404 B1 2/2006 Sollami
7,204,560 B2 4/2007 Mercier
2002/0070602 A1 6/2002 Sollami
2002/0074851 A1 6/2002 Montgomery
2002/0153175 A1 10/2002 Ojanen
2002/0175555 A1 11/2002 Mercier
2003/0137185 A1 7/2003 Sollami
2003/0140350 A1 7/2003 Noro
2003/0141753 A1 7/2003 Peay
2003/0209366 A1 11/2003 McAlvain
2003/0230926 A1 12/2003 Mondy
2003/0234280 A1 12/2003 Cadden
2004/0026983 A1 2/2004 McAlvain
2004/0065484 A1 4/2004 McAlvain
2005/0159840 A1 7/2005 Lin
2005/0173966 A1 8/2005 Mouthaan
2006/0125306 A1 6/2006 Sollami
2006/0237236 A1 10/2006 Sreshta

* cited by examiner

ATTACK TOOL

CROSS REFERENCE IS RELATED APPLICATIONS

This application is a continuation-in-part of U.S. patent application Ser. No. 11/463,975 which was filed on Aug. 11, 2006 and entitled An Attack Tool. U.S. patent application Ser. No. 11/463,975 is a continuation-in-part of U.S. patent application Ser. No. 11/463,962 which was filed on Aug. 11, 2006 and entitled An Attack Tool. All of these applications are herein incorporated by reference for all that it contains.

BACKGROUND OF THE INVENTION

Formation degradation, such as asphalt milling, mining, or excavating, may result in wear on attack tools. Consequently, many efforts have been made to extend the life of these tools. Examples of such efforts are disclosed in U.S. Pat. No. 4,944,559 to Sionnet et at, U.S. Pat. No. 5,837,071 to Andersson et al., U.S. Pat. No. 5,417,475 to Graham et al., U.S. Pat. No. 6,051,079 to Andersson et al., and U.S. Pat. No. 4,725,098 to Beach, all of which are herein incorporated by reference for all that they disclose.

BRIEF SUMMARY OF THE INVENTION

In one aspect of the invention, an attack tool is disclosed which comprises a wear-resistant base suitable for attachment to a driving mechanism. The wear-resistant base has a shank and a metal segment. A cemented metal carbide segment is bonded to the metal segment and the shank has a wear-resistant surface. The wear-resistant surface has a hardness greater than 60 HRc.

In this disclosure, the abbreviation "HRc" stands for the Rockwell Hardness "C" scale, and the abbreviation "HK" stands for Knoop Hardness.

DETAILED DESCRIPTION OF THE INVENTION AND THE PREFERRED EMBODIMENT

It will be readily understood that the components of the present invention, as generally described and illustrated in the Figures herein, may be arranged and designed in a wide variety of different configurations. Thus, the following more detailed description of embodiments of the methods of the present invention, as represented in the Figures is not intended to limit the scope of the invention, as claimed, but is merely representative of various selected embodiments of the invention.

The illustrated embodiments of the invention will best be understood by reference to the drawings, wherein like parts are designated by like numerals throughout. Those of ordinary skill in the art will, of course, appreciate that various modifications to the methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
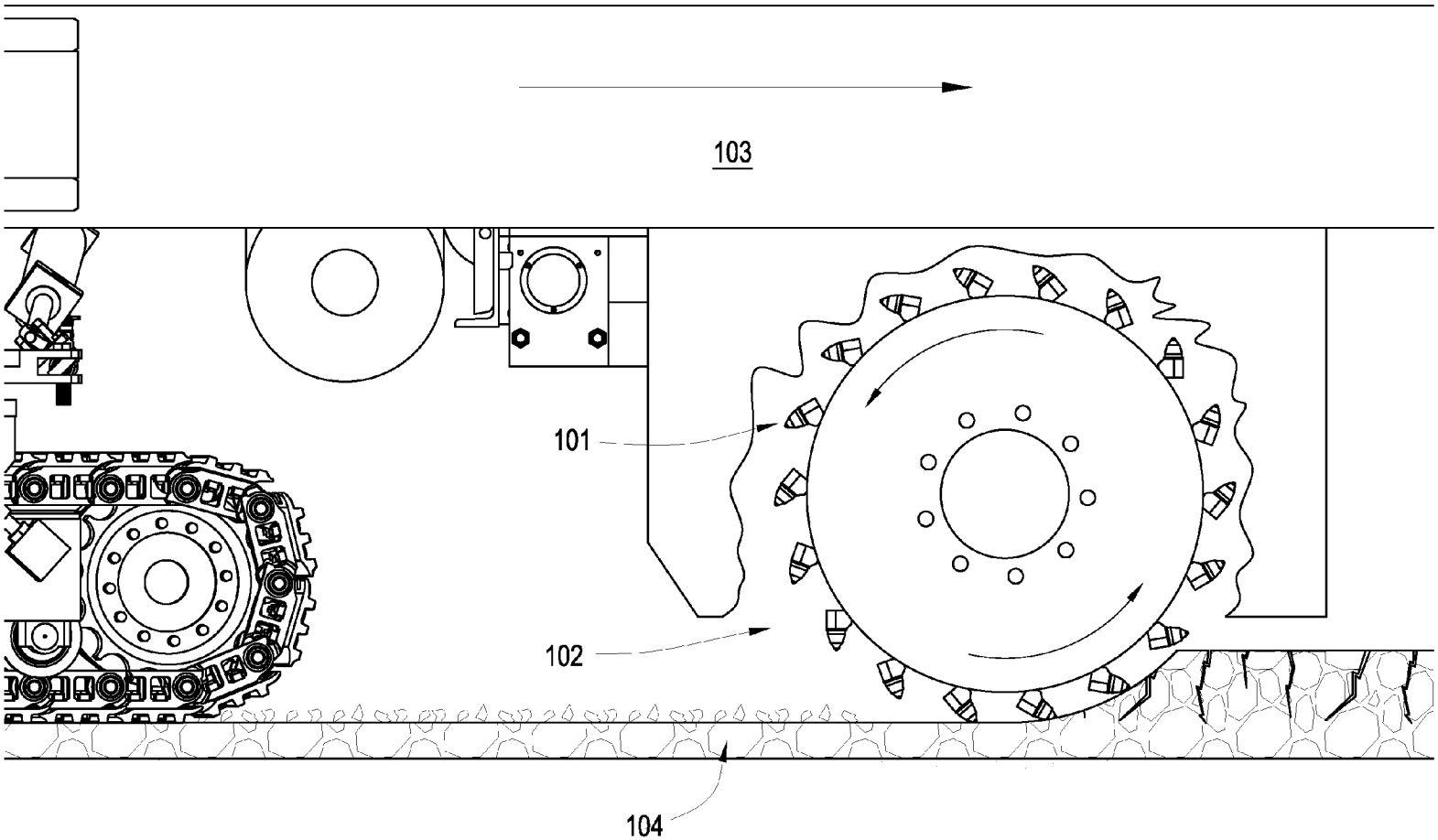
FIG. 1 is a cross-sectional diagram of an embodiment of attack tools on a rotating drum attached to a motor vehicle.

FIG. 1 is a cross-sectional diagram of an embodiment of an attack tool 101 on a rotating drum 102 attached to a motor vehicle 103. The motor vehicle 103 may be a cold planer used to degrade man-made formations such as pavement 104 prior to the placement of a new layer of pavement, a mining vehicle used to degrade natural formations, or an excavating machine. Tools 101 may be attached to a drum 102 or a chain which rotates so the tools 101 engage a formation. The formation that the tool 101 engages may be hard and/or abrasive and cause substantial wear on tools 101. The wear-resistant tool 101 may be selected from the group consisting of drill bits, asphalt picks, mining picks, hammers, indenters, shear cutters, indexable cutters, and combinations thereof. In large operations, such as pavement degradation or mining, when tools 101 need to be replaced the entire operation may cease while crews remove worn tools 101 and replace them with new tools 101. The time spent replacing tools 101 may be costly.

Figure 2:
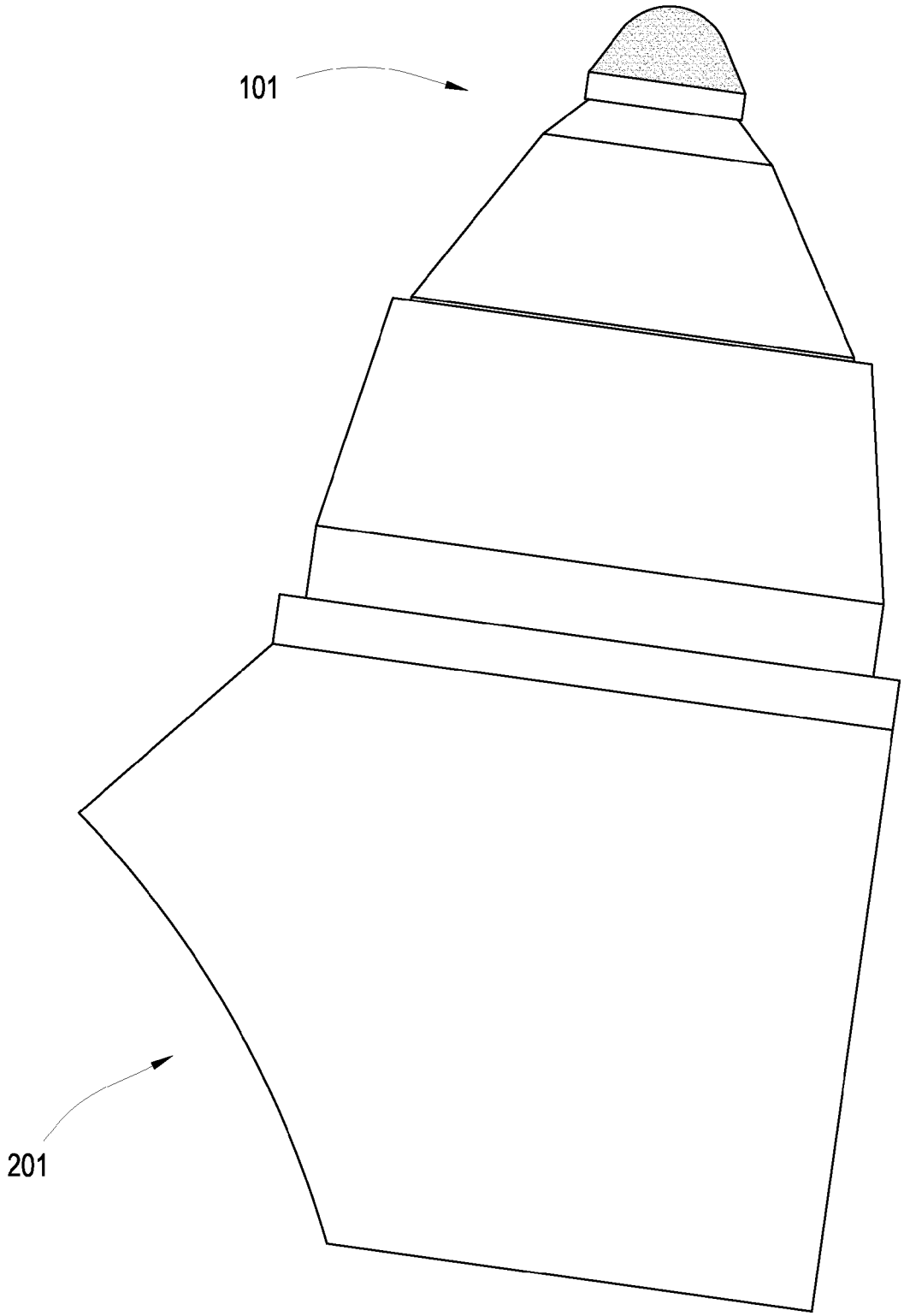
FIG. 2 is an orthogonal diagram of an embodiment of an attack tool and a holder.

FIG. 2 is an orthogonal diagram of an embodiment of a tool 101 and a holder 201. A tool 101/holder 201 combination is often used in asphalt milling and mining. A holder 201 is attached to a driving mechanism, which may be a rotating drum 102, and the tool 101 is inserted into the holder 201. The holder 201 may hold the tool 101 at an angle offset from the direction of rotation, such that the tool 101 optimally engages a formation.

Figure 3:
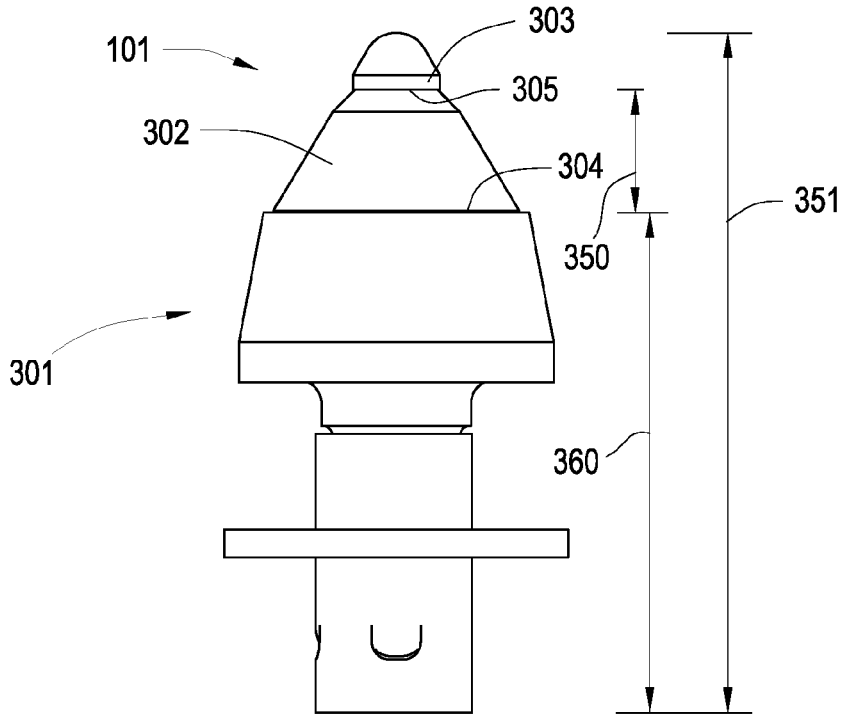
FIG. 3 is an orthogonal diagram of another embodiment of an attack tool.

FIG. 3 is an orthogonal diagram of an embodiment of a tool 101 with a first cemented metal carbide segment with a first volume. The tool 101 comprises a base 301 suitable for attachment to a driving mechanism, a first cemented metal carbide segment 302 bonded to the base 301 at a first interface 304, and a second metal carbide segment 303 bonded to the first carbide segment 302 at a second interface 305 opposite the base 301. The first cemented metal carbide segment 302 may comprise a first volume of 100 cubic inches to 2 cubic inches. Such a volume may be beneficial in absorbing impact stresses and protecting the rest of the tool 101 from wear. The first and/or second interfaces 304, 305 may be planar as well. The first and/or second metal carbide segments 302, 303 may comprise tungsten, titanium, tantalum, molybdenum, niobium, cobalt and/or combinations thereof.

Further, the tool 101 may comprise a ratio of the length 350 of the first cemented metal carbide segment 302 to the length of the whole attack tool 351 which is 1/10 to 1/2; preferably the ratio is 1/7to 1/2.5. The wear-resistant base 301 may comprise a length 360 that is at least half of the tool's length 351.

Figure 4:
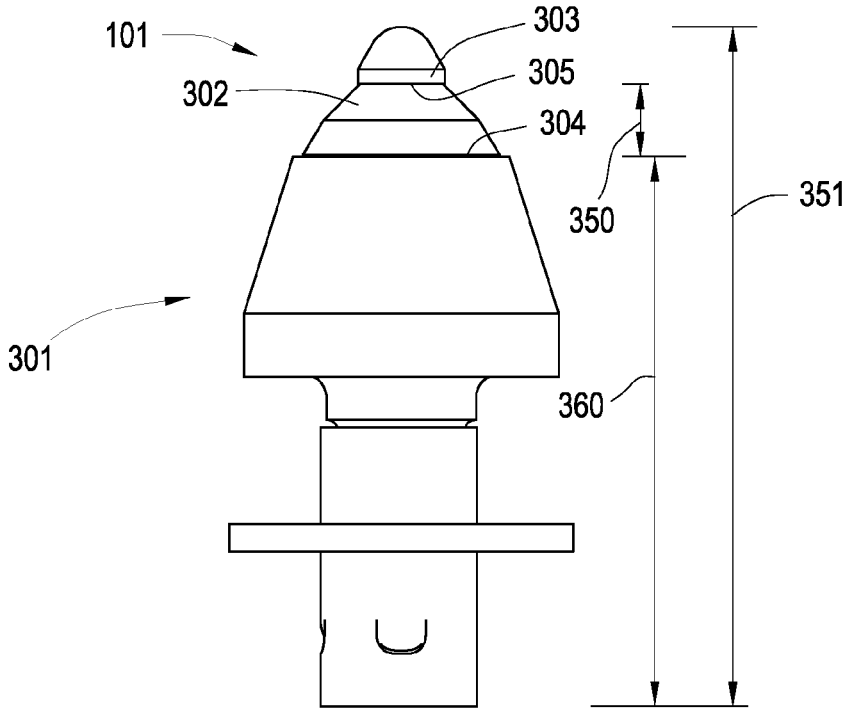
FIG. 4 is an orthogonal diagram of another embodiment of an attack tool.

FIG. 4 is an orthogonal diagram of an embodiment of a tool with a first cemented metal carbide segment with a second volume, which is less than the first volume. This may help to reduce the weight of the tool 101 which may require less horsepower to move or it may help to reduce the cost of the attack tool.

Figure 5:
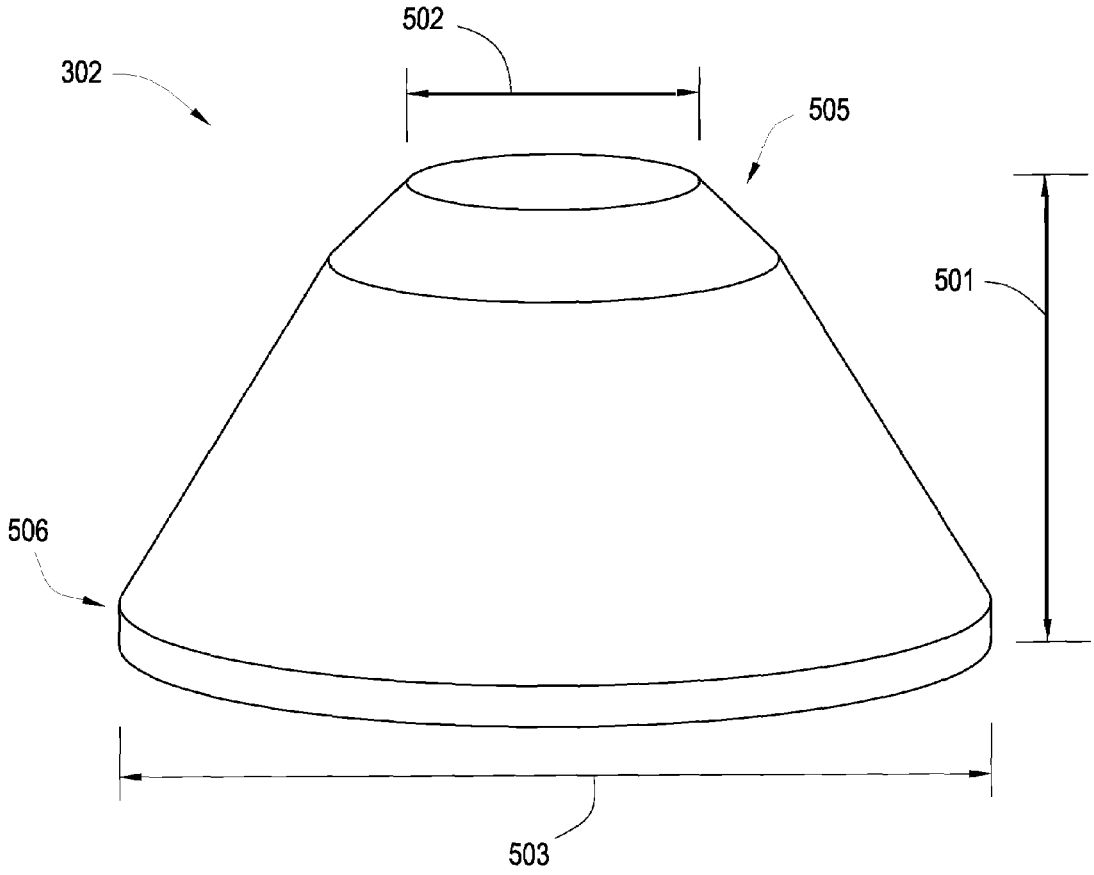
FIG. 5 is a perspective diagram of a first cemented metal carbide segment.

FIG. 5 is a perspective diagram of a first cemented metal carbide segment. The volume of the first segment 302 may be 0.100 to 2 cubic inches; preferably the volume may be 0.350 to 0.550 cubic inches. The first segment 302 may comprise a height 501 of 0.2 inches to 2 inches; preferably the height 501 may be 0.500 inches to 0.800 inches. The first segment 302 may comprise an upper cross-sectional thickness 502 of 0.250 to 0.750 inches; preferably the upper cross-sectional thickness 502 may be 0.300 inches to 0.500 inches. The first segment 302 may also comprise a lower cross-sectional thickness 503 of 1 inch to 1.5 inches; preferably the lower cross-sectional thickness 503 may be 1.10 inches to 1.30 inches. The upper and lower cross-sectional thicknesses 502, 503 may be planar. The first segment 302 may also comprise a nonuniform cross-sectional thickness. Further, the segment 302 may have features such as a chamfered edge 505 and a ledge 506 to optimize bonding and/or improve performance.

FIGS. 6-10 are orthogonal diagrams of several embodiments of a first cemented metal carbide segment. Each figure discloses planar upper and lower ends 601, 602. When the ends 601, 602 are bonded to the base 301 and second segment 303, the resulting interfaces 304, 305 may also be planar. In other embodiments, the ends comprise a non-planar geometry such as a concave portion, a convex portion, ribs, splines, recesses, protrusions, and/or combinations thereof.

Figure 6:
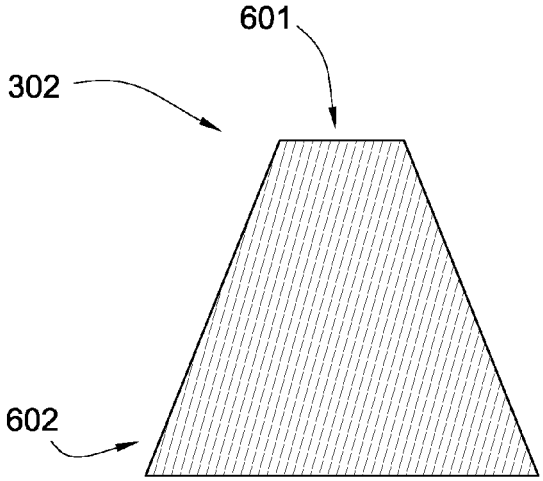
FIG. 6 is an orthogonal diagram of an embodiment of a first cemented metal carbide segment.
Figure 7:
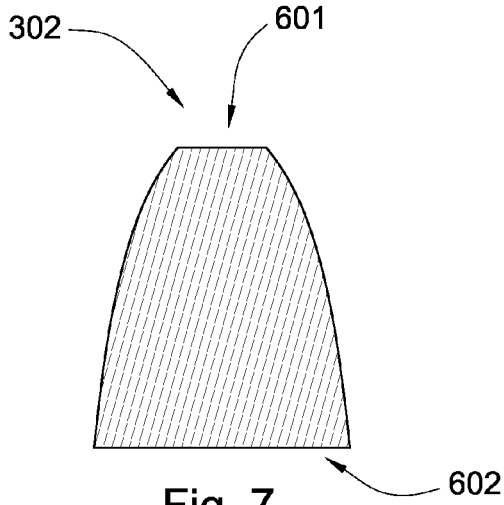
FIG. 7 is an orthogonal diagram of another embodiment of a first cemented metal carbide segment.
Figure 8:
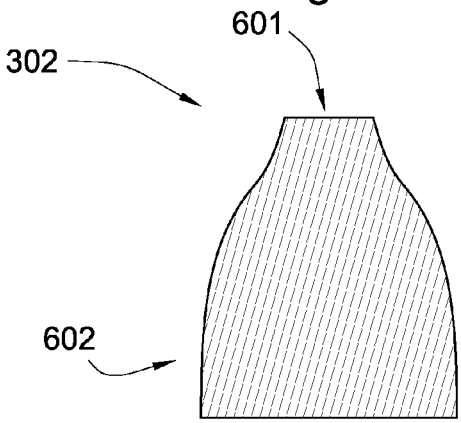
FIG. 8 is an orthogonal diagram of another embodiment of a first cemented metal carbide segment.
Figure 9:
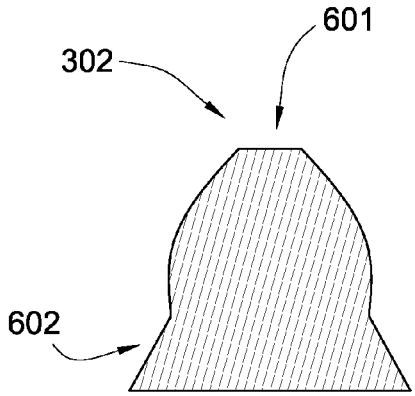
FIG. 9 is an orthogonal diagram of another embodiment of a first cemented metal carbide segment.
Figure 10:
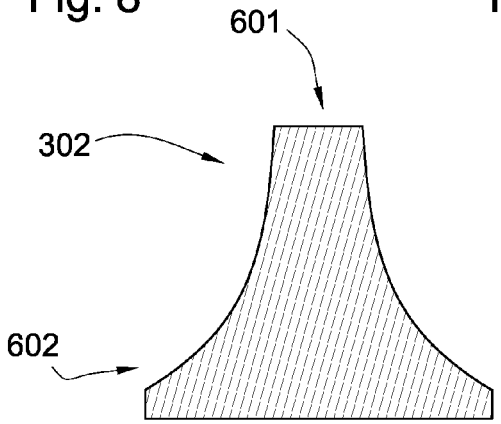
FIG. 10 is an orthogonal diagram of another embodiment of a first cemented metal carbide segment.

The first segment 302 may comprise various geometries. The geometry may be optimized to move cuttings away from the tool 101, distribute impact stresses, reduce wear, improve degradation rates, protect other parts of the tool 101, and/or combinations thereof. The embodiments of FIGS. 6 and 7, for instance, may be useful for protecting the tool 101. FIG. 6 comprises an embodiment of the first segment 302 without features such as a chamfered edge 505 and a ledge 506. The bulbous geometry of the first segment 302 in FIGS. 8 and 9 may be sacrificial and may extend the life of the tool 101. A segment 302 as disclosed in FIG. 10 may be useful in moving cuttings away from the tool 101 and focusing cutting forces at a specific point.

FIGS. 11-16 are cross-sectional diagrams of several embodiments of a second cemented metal carbide segment and a superhard material. The second cemented metal carbide segment 303 may be bonded to a superhard material 306 opposite the interface 304 between the first segment 302 and the base 301. In other embodiments, the superhard material is bonded to any portion of the second segment. The interface 1150 between the second segment 303 and the superhard material 306 may be non-planar or planar. The superhard material 306 may comprise polycrystalline diamond, vapor-deposited diamond, natural diamond, cubic boron nitride, infiltrated diamond, layered diamond, diamond impregnated carbide, diamond impregnated matrix, silicon bonded diamond, or combinations thereof. The superhard material may be at least 4,000 HK and in some embodiments it may be 1 to 20000 microns thick. In embodiments, where the superhard material is a ceramic, the material may comprise a region 1160 (preferably near its surface 1151) that is free of binder material. The average grain size of a superhard ceramic may be 10 to 100 microns in size. Infiltrated diamond is typical made by sintering the superhard material adjacent a cemented metal carbide and allowing a metal (such as cobalt) to infiltrate into the superhard material. The superhard material may be a synthetic diamond comprising a binder concentration of 4 to 35 weight percent.

Figure 11:
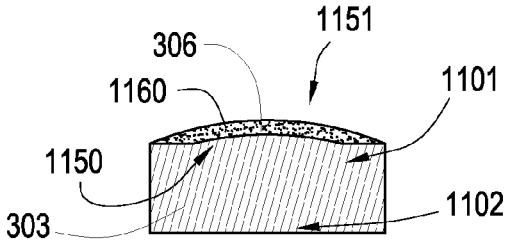
FIG. 11 is a cross-sectional diagram of an embodiment of a second cemented metal carbide segment and a superhard material.
Figure 12:
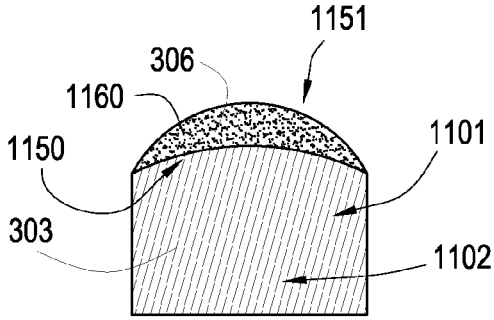
FIG. 12 is a cross-sectional diagram of another embodiment of a second cemented metal carbide segment and a superhard material.
Figure 13:
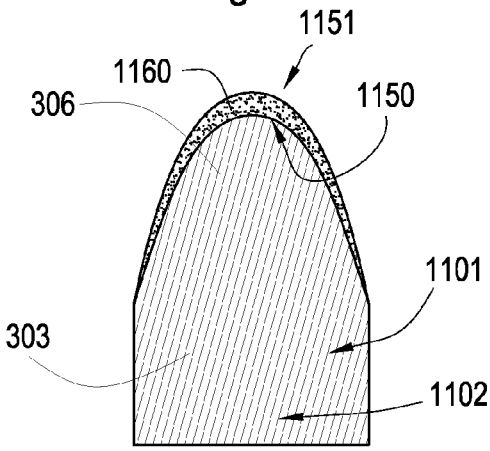
FIG. 13 is a cross-sectional diagram of another embodiment of a second cemented metal carbide segment and a superhard material.
Figure 14:
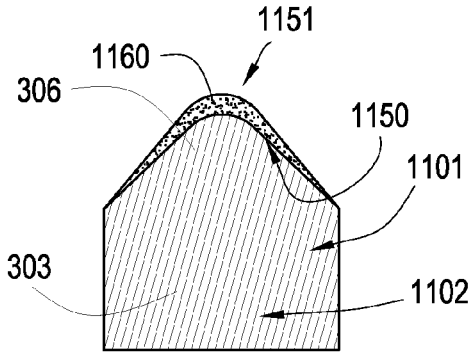
FIG. 14 is a cross-sectional diagram of another embodiment of a second cemented metal carbide segment and a superhard material.
Figure 15:
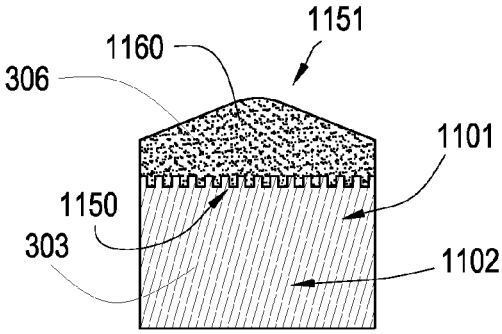
FIG. 15 is a cross-sectional diagram of another embodiment of a second cemented metal carbide segment and a superhard material.
Figure 16:
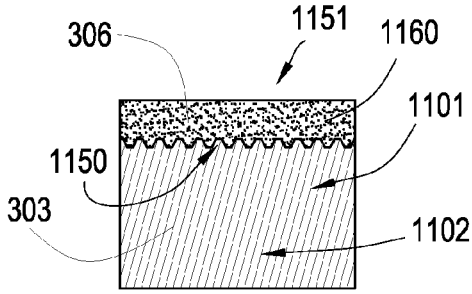
FIG. 16 is a cross-sectional diagram of another embodiment of a second cemented metal carbide segment and a superhard material.

The second segment 303 and superhard material may comprise many geometries. In FIG. 11 the second segment 303 has a relatively small surface area to bind with the superhard material reducing the amount of superhard material required and reducing the overall cost of the attack tool. In embodiments, where the superhard material is a polycrystalline diamond, the smaller the second carbide segment the cheaper it may be to produce large volumes of attack tool since more second segments may be placed in a high temperature high pressure apparatus at once. The superhard material 306 in FIG. 11 comprises a semi-round geometry. The superhard material in FIG. 12 comprises a domed geometry. The superhard material 306 in FIG. 13 comprises a mix of domed and conical geometry. Blunt geometries, such as those disclosed in FIGS. 11-13 may help to distribute impact stresses during formation degradation, but cutting efficiency may be reduced. The superhard material 306 in FIG. 14 comprises a conical geometry. The superhard material 306 in FIG. 15 comprises a modified conical geometry, and the superhard material in FIG. 16 comprises a flat geometry. Sharper geometries, such as those disclosed in FIGS. 14 and 15, may increase cutting efficiency, but more stress may be concentrated to a single point of the geometry upon impact. A flat geometry may have various benefits when placed at a positive cutting rake angle or other benefits when placed at a negative cutting rake angle.

The second segment 303 may comprise a region 1102 proximate the second interface 305 which may comprise a higher concentration of a binder than a distal region 1101 of the second segment 303 to improve bonding or add elasticity to the tool. The binder may comprise cobalt, iron, nickel, ruthenium, rhodium, palladium, chromium, manganese, tantalum, or combinations thereof.

Figure 17:
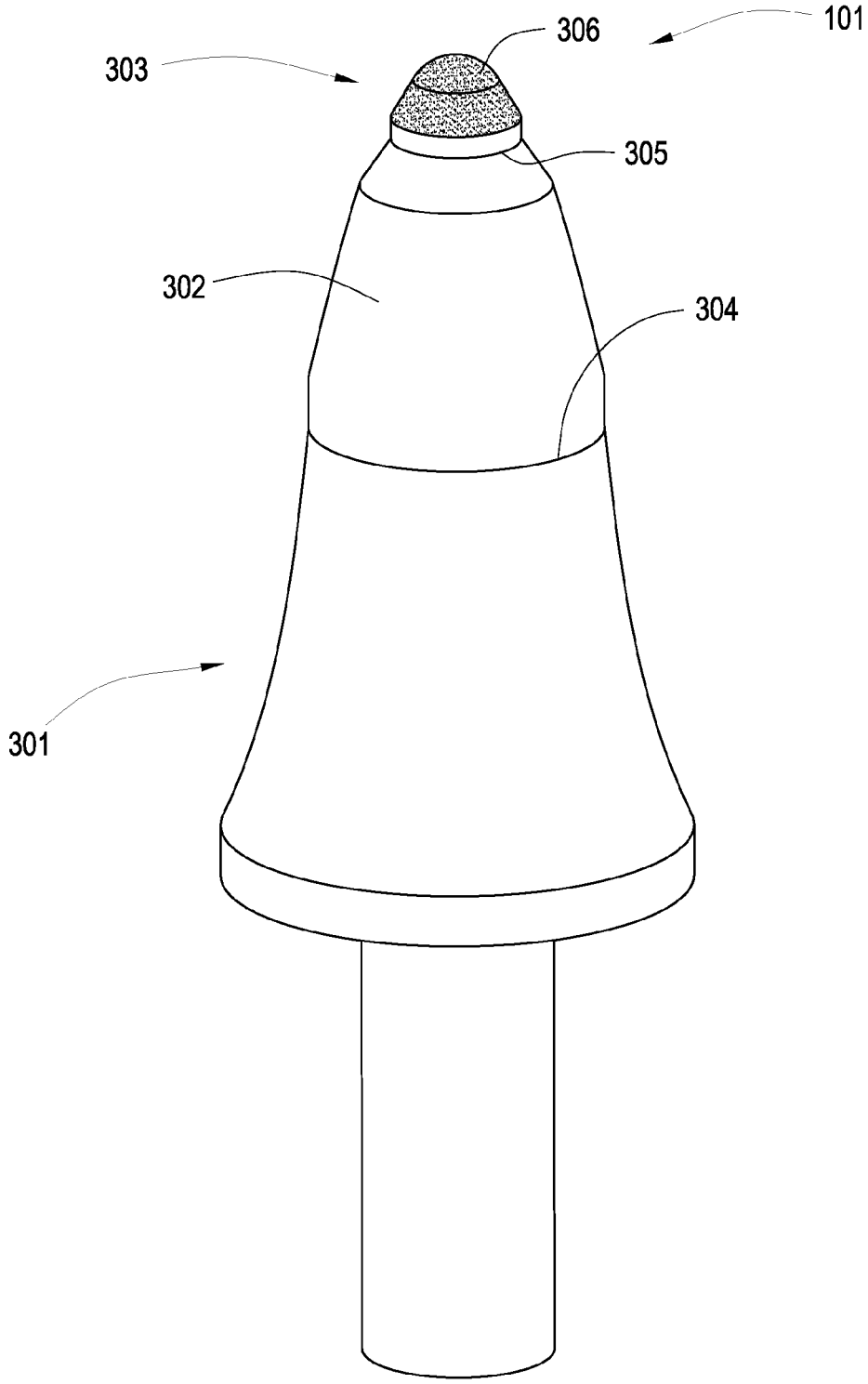
FIG. 17 is a perspective diagram of another embodiment of an attack tool.

FIG. 17 is a perspective diagram of another embodiment of a tool. Such a tool 101 may be used in mining. Mining equipment, such as continuous miners, may use a driving mechanism to which tools 101 may be attached. The driving mechanism may be a rotating drum 102, similar to that used in asphalt milling, which may cause the tools 101 to engage a formation, such as a vein of coal or other natural resources. Tools 101 used in mining may be elongated compared to similar tools 101 like picks used in asphalt cold planars.

Figure 18:
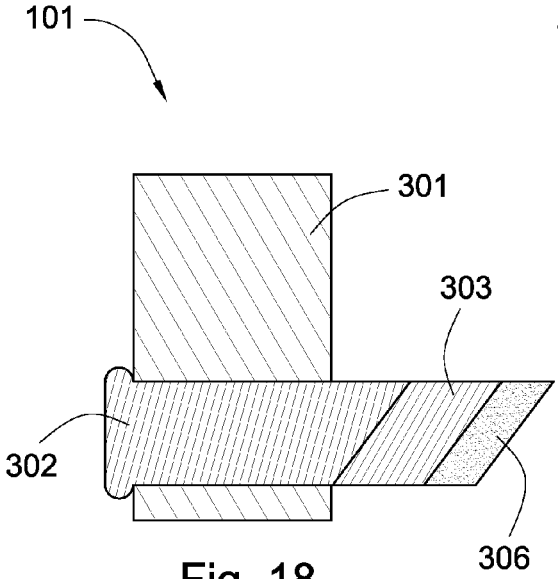
FIG. 18 is an orthogonal diagram of an alternate embodiment of an attack tool.
Figure 19:
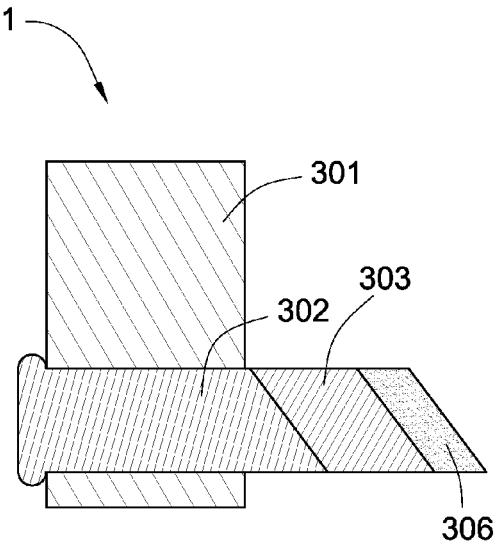
FIG. 19 is an orthogonal diagram of another alternate embodiment of an attack tool.
Figure 20:
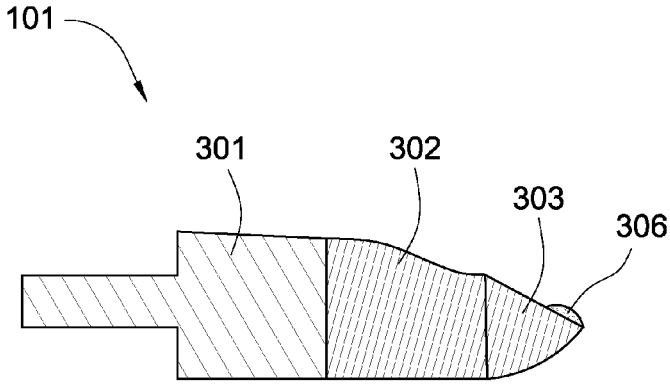
FIG. 20 is an orthogonal diagram of another alternate embodiment of an attack tool.

FIGS. 18-20 are cross-sectional diagrams of alternate embodiments of an attack tool. These tools are adapted to remain stationary within the holder 201 attached to the driving mechanism. Each of the tools 101 may comprise a base segment 301 which may comprise steel, a cemented metal carbide, or other metal. The tools 101 may also comprise first and second segments 302, 303 bonded at interfaces 304, 305. The angle and geometry of the superhard material 306 may be altered to change the cutting ability of the tool 101. Positive or negative rake angles may be used along with geometries that are semi-rounded, rounded, domed, conical, blunt, sharp, scoop, or combinations thereof. Also the superhard material may be flush with the surface of the carbide or it may extend beyond the carbide as well.

Figure 21:
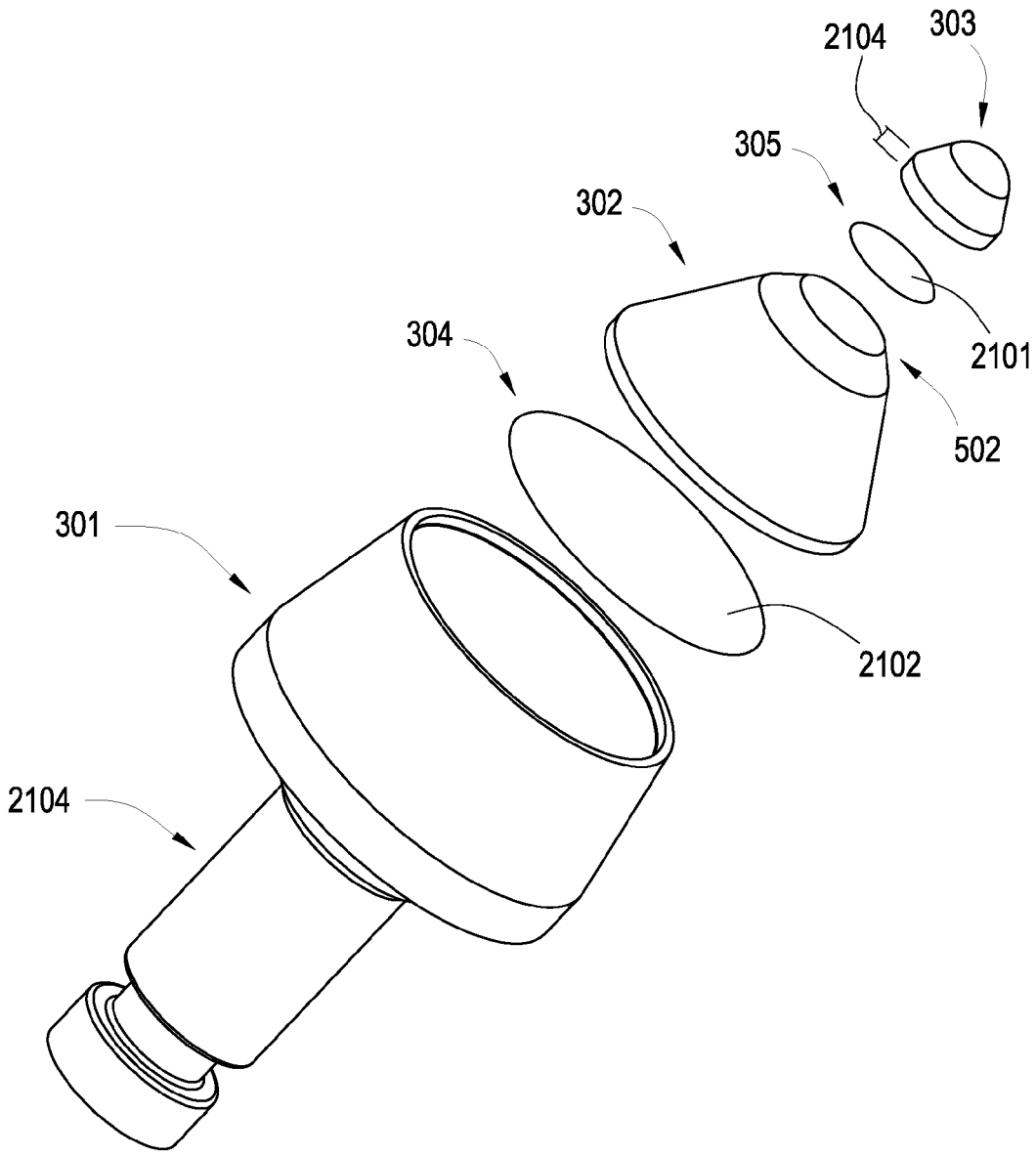
FIG. 21 is an exploded perspective diagram of another embodiment of an attack tool.

FIG. 21 is an exploded perspective diagram of an embodiment of an attack tool. The tool 101 comprises a wear-resistant base 301 suitable for attachment to a driving mechanism, a first cemented metal carbide segment 302 brazed to the wear-resistant base at a first interface 304, a second cemented metal carbide segment 303 brazed to the first cemented metal carbide segment 302 at a second interface 305 opposite the wear-resistant base 301, a shank 2104, and a braze material 2101 disposed in the second interface 305 comprising 30 to 62 weight percent of palladium. Preferably, the braze material comprises 40 to 50 weight percent of palladium.

The braze material 2101 may comprise a melting temperature from 700 to 1200 degrees Celsius; preferably the melting temperature is from 800 to 970 degrees Celsius. The braze material may comprise silver, gold, copper nickel, palladium, boron, chromium, silicon, germanium, aluminum, iron, cobalt, manganese, titanium, tin, gallium, vanadium, phosphorus, molybdenum, platinum, or combinations thereof. The braze material 2101 may comprise 30 to 60 weight percent nickel, 30 to 62 weight percent palladium, and 3 to 15 weight percent silicon; preferably the first braze material 2101 may comprise 47.2 weight percent nickel, 46.7 weight percent palladium, and 6.1 weight percent silicon. Active cooling during brazing may be critical in some embodiments, since the heat from brazing may leave some residual stress in the bond between the second carbide segment and the superhard material. The second carbide segment 303 may comprise a length of 0.1 to 2 inches. The superhard material 306 may be 0.020 to 0.100 inches away from the interface 305. The further away the superhard material 306 is, the less thermal damage is likely to occur during brazing. Increasing the distance 2104 between the interface 305 and the superhard material 306, however, may increase the moment on the second carbide segment and increase stresses at the interface 305 upon impact.

The first interface 304 may comprise a second braze material 2102 which may comprise a melting temperature from 800 to 1200 degrees Celsius. The second braze material 2102 may comprise 40 to 80 weight percent copper, 3 to 20 weight percent nickel, and 3 to 45 weight percent manganese; preferably the second braze material 2101 may comprise 67.5 weight percent copper, 9 weight percent nickel, and 23.5 weight percent manganese.

Further, the first cemented metal carbide segment 302 may comprise an upper end 601 and the second cemented metal carbide segment may comprise a lower end 602, wherein the upper and lower ends 601, 602 are substantially equal.

Figure 22:
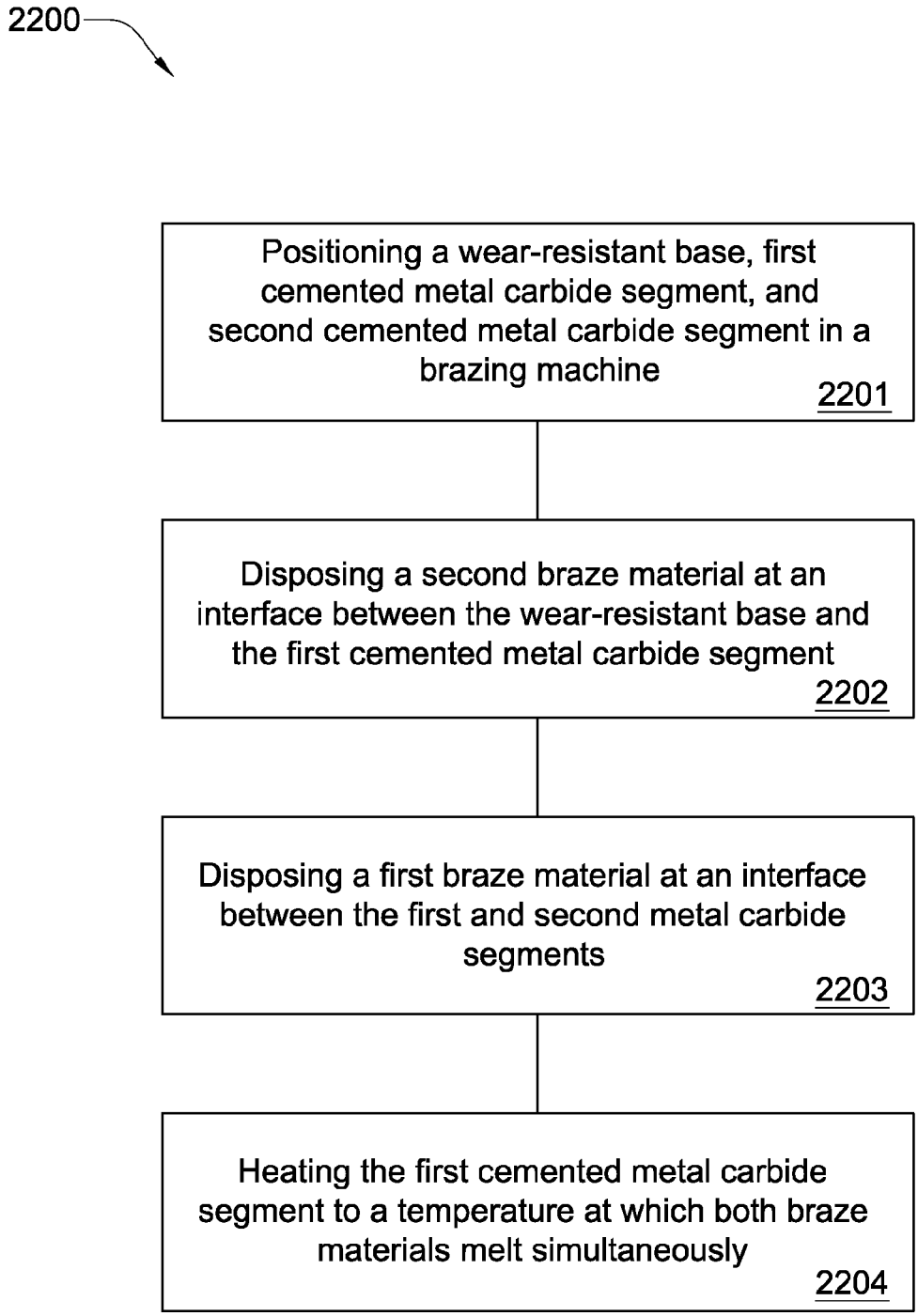
FIG. 22 is a schematic of a method of manufacturing an attack tool.

FIG. 22 is a schematic of a method of manufacturing a tool. The method 2200 comprises positioning 2201 a wear-resistant base 301, first cemented metal carbide segment 302, and second cemented metal carbide segment 303 in a brazing machine, disposing 2202 a second braze material 2102 at an interface 304 between the wear-resistant base 301 and the first cemented metal carbide segment 302, disposing 2203 a first braze material 2101 at an interface 305 between the first and second cemented metal carbide segments 302, 303, and heating 2204 the first cemented metal carbide segment 302 to a temperature at which both braze materials melt simultaneously. The method 2200 may comprise an additional step of actively cooling the attack tool, preferably the second carbide segment 303, while brazing. The method 2200 may further comprise a step of air-cooling the brazed tool 101.

The interface 304 between the wear-resistant base 301 and the first segment 302 may be planar, and the interface 305 between the first and second segments 302, 303 may also be planar. Further, the second braze material 2102 may comprise 50 to 70 weight percent of copper, and the first braze material 2101 may comprise 40 to 50 weight percent palladium.

Figure 23:
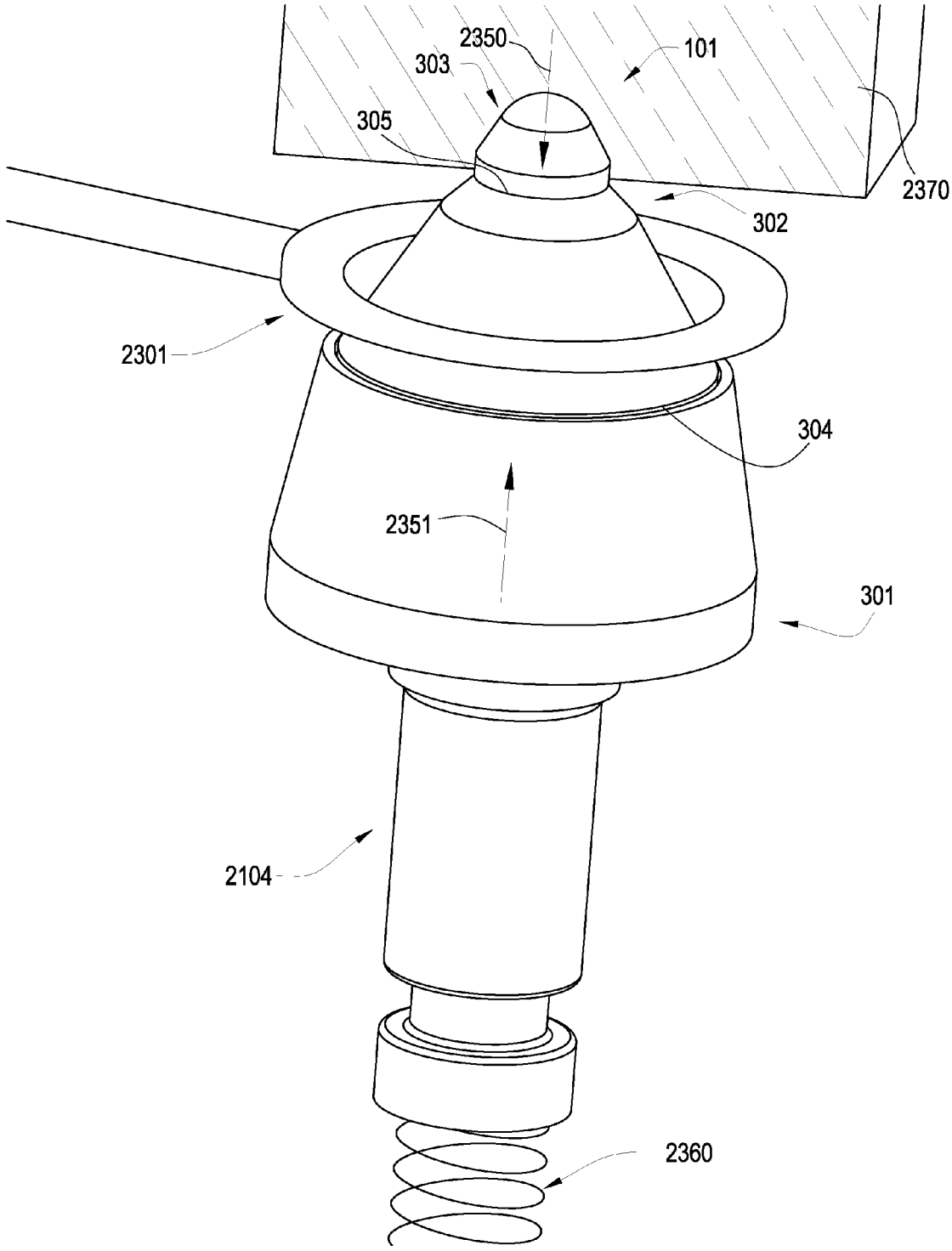
FIG. 23 is a perspective diagram of tool segments being brazed together.

FIG. 23 is a perspective diagram of tool segments being brazed together. The attack tool 101 may be assembled as described in the above method 2200. Force, indicated by arrows 2350 and 2351, may be applied to the tool 101 to keep all components in line. A spring 2360 may urge the shank 2104 upwards and positioned within the machine (not shown). There are various ways to heat the first segment 302, including using an inductive coil 2301. The coil 2301 may be positioned to allow optimal heating at both interfaces 304, 305 to occur. Brazing may occur in an atmosphere that is beneficial to the process. Using an inert atmosphere may eliminate elements such as oxygen, carbon, and other contaminates from the atmosphere that may contaminate the braze material 2101, 2102.

The tool may be actively cooled as it is being brazed. Specifically, the superhard material 306 may be actively cooled. A heat sink 2370 may be placed over at least part of the second segment 303 to remove heat during brazing. Water or other fluid may be circulated around the heat sink 2370 to remove the heat. The heat sink 2370 may also be used to apply a force on the tool 101 to hold it together while brazing.

Figure 24:
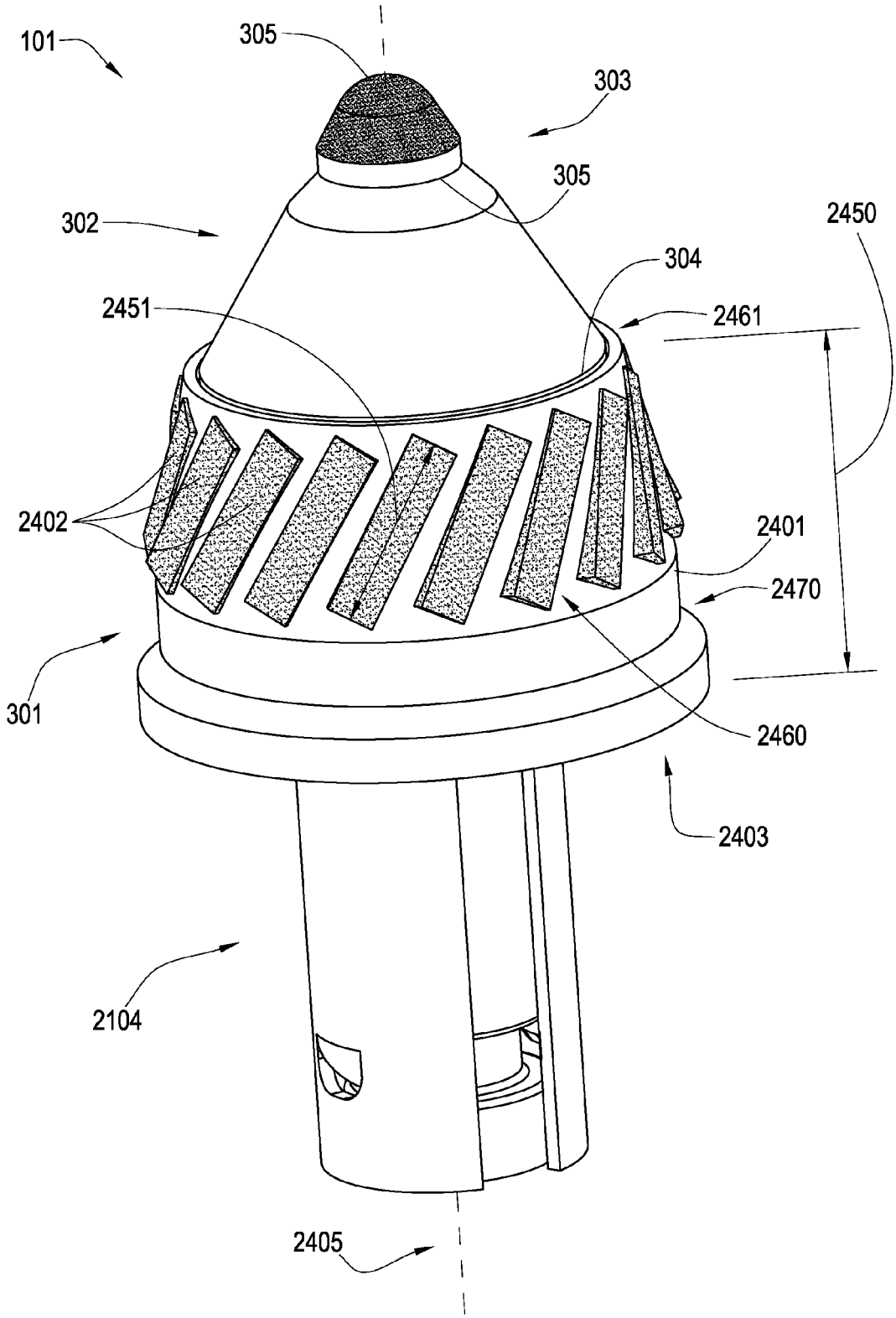
FIG. 24 is a perspective diagram of an embodiment of an attack tool with inserts bonded to the wear-resistant base.

FIG. 24 is a perspective diagram of an embodiment of a tool with inserts in the wear-resistant base. An attack tool 101 may comprise a wear-resistant base 301 suitable for attachment to a driving mechanism, the wear-resistant base comprising a shank 2104 and a metal segment 2401; a cemented metal carbide segment 302 bonded to the metal segment 2401 opposite the shank 2104; and at least one hard insert 2402 bonded to the metal segment 2401 proximate the shank wherein the insert 2402 comprises a hardness greater than 60 HRc. The metal segment 2401 may comprise a hardness of 40 to 50 HRc. The metal segment 2401 and shank 2104 may be made from the same piece of material.

The insert 2402 may comprise a material selected from the group consisting of diamond, natural diamond, polycrystalline diamond, cubic boron nitride, vapor-deposited diamond, diamond grit, polycrystalline diamond grit, cubic boron nitride grit, chromium, tungsten, titanium, molybdenum, niobium, a cemented metal carbide, tungsten carbide, aluminum oxide, zircon, silicon carbide, whisker reinforced ceramics, diamond impregnated carbide, diamond impregnated matrix, silicon bonded diamond, or combinations thereof as long as the hardness of the material is greater than 60 HRc. Having an insert 2402 that is harder than the metal segment 2401 may decrease the wear on the metal segment 2401. The insert 2402 may comprise a cross-sectional thickness of 0.030 to 0.500 inches. The insert 2402 may comprise an axial length 2451 less than an axial length 2450 of the metal segment 2402, and the insert 2402 may comprise a length shorter than a circumference 2470 of the metal segment 2401 proximate the shank 2104. The insert 2402 may be brazed to the metal segment 2401. The insert 2402 may be a ceramic with a binder comprising 4 to 35 weight percent of the insert. The insert 2402 may also be polished.

The base 301 may comprise a ledge 2403 substantially normal to an axial length of the tool 101, the axial length being measured along the axis 2405 shown. At least a portion of a perimeter 2460 of the insert 2402 may be within 0.5 inches of the ledge 2403. If the ratio of the length 350 of the first cemented metal carbide segment 302 to the length of the whole attack tool 351 may be 1/10 to 1/2, the wear-resistant base 301 may comprise as much as 9/10 to 1/2 of the tool 101. An insert's axial length 2451 may not exceed the length of the wear-resistant base's length 360. The insert's perimeter 2460 may extend to the edge 2461 of the wear-resistant base 301, but the first carbide segment 302 may be free of an insert 2402. The insert 2402 may be disposed entirely on the wear-resistant base 301. Further, the metal segment 2401 may comprise a length 2450 which is greater than the insert's length 2451; the perimeter 2460 of the insert 2402 may not extend beyond the ledge 2403 of the metal segment 2401 or beyond the edge of the metal segment 2461.

Inserts 2402 may also aid in tool rotation. Attack tools 101 often rotate within their holders upon impact which allows wear to occur evenly around the tool 101. The inserts 2402 may be angled such so that it cause the tool 101 to rotate within the bore of the holder.

Figure 25:
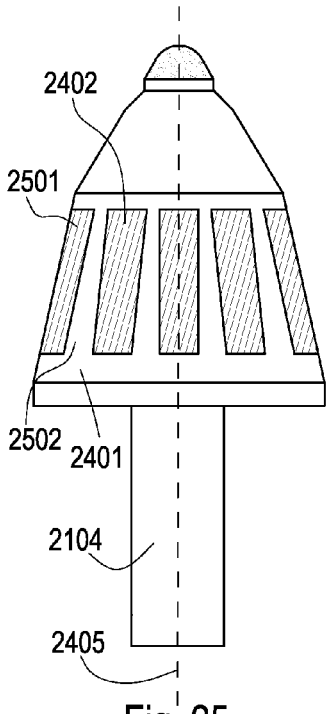
FIG. 25 is an orthogonal diagram of an embodiment of insert geometry.

FIGS. 25-30 are orthogonal diagrams of several embodiments of insert geometries. The insert 2402 may comprise a generally circular shape, a generally rectangular shape, a generally annular shape, a generally spherical shape, a generally pyramidal shape, a generally conical shape, a generally accurate shape, a generally asymmetric shape, or combinations thereof. The distal most surface 2501 of the insert 2402 may be flush with the surface 2502 of the wear-resistant base 301, extend beyond the surface 2502 of the wear-resistant base 301, be recessed into the surface 2502 of the wear-resistant base, or combinations thereof. An example of the insert 2402 extending beyond the surface 2502 of the base 301 is seen in if FIG. 24. FIG. 25 discloses generally rectangular inserts 2402 that are aligned with a central axis 2405 of the tool 101.

Figure 26:
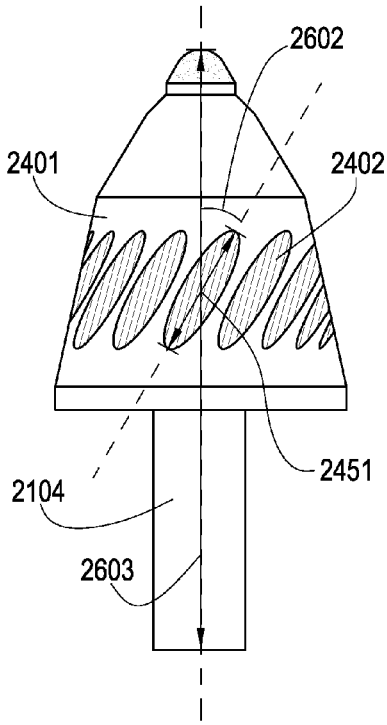
FIG. 26 is an orthogonal diagram of another embodiment of insert geometry.

FIG. 26 discloses an insert 2402 comprising an axial length 2451 forming an angle 2602 of 1 to 75 degrees with an axial length 2603 of the tool 101. The inserts 2402 may be oblong.

Figure 27:
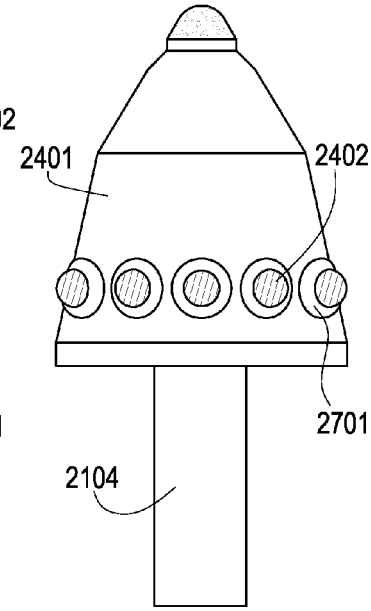
FIG. 27 is an orthogonal diagram of another embodiment of insert geometry.
Figure 28:
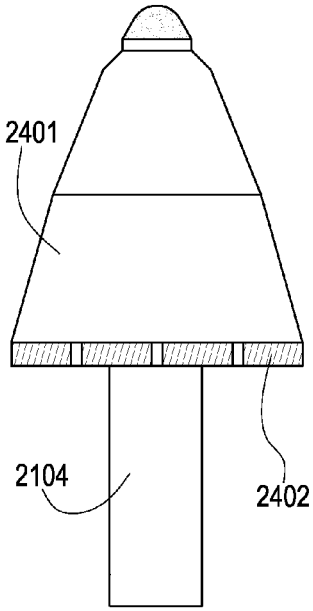
FIG. 28 is an orthogonal diagram of another embodiment of insert geometry.
Figure 29:
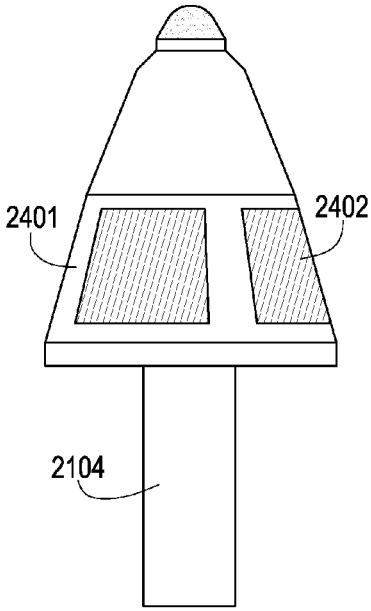
FIG. 29 is an orthogonal diagram of another embodiment of insert geometry.
Figure 30:
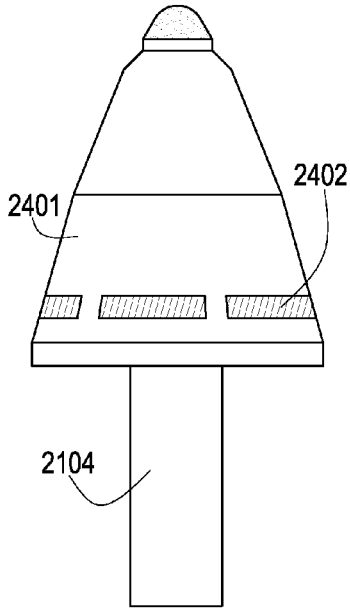
FIG. 30 is an orthogonal diagram of another embodiment of insert geometry.

FIG. 27 discloses a circular insert 2402 bonded to a protrusion 2701 formed in the base. The insert 2402 may be flush with the surface of the protrusion 2701, extend beyond the protrusion 2701, or be recessed within the protrusion 2701. A protrusion 2701 may help extend the insert 2402 so that the wear is decreased as the insert 2402 takes more of the impact. FIGS. 28-30 disclose segmented inserts 2402 that may extend considerably around the metal segment's circumference 2470. The angle formed by insert's axial length 2601 may also be 90 degrees from the tool's axial length 2603.

Figure 31:
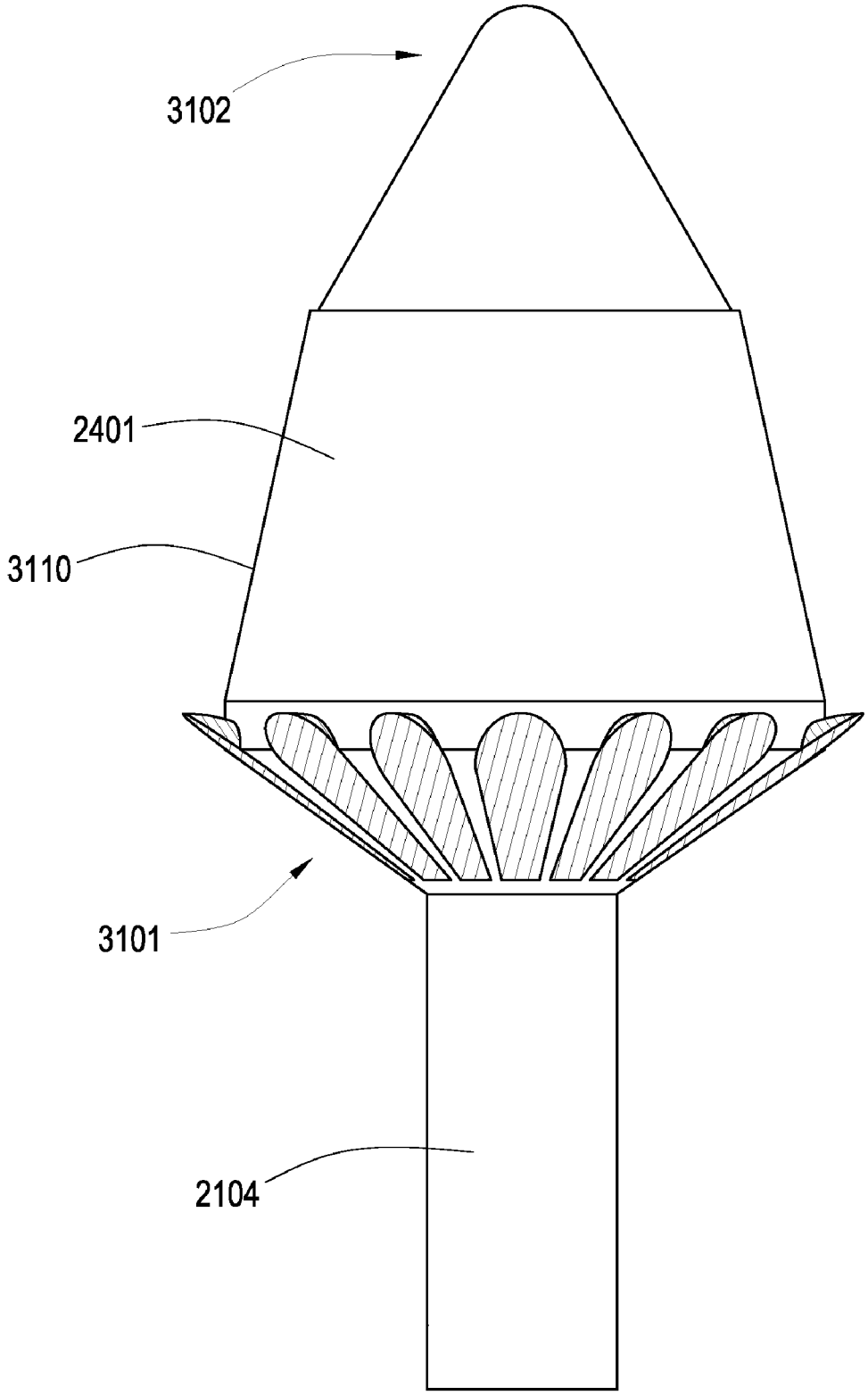
FIG. 31 is an orthogonal diagram of another embodiment of an attack tool.

FIG. 31 is an orthogonal diagram of another embodiment of a tool. The base 301 of an attack tool 101 may comprise a tapered region 3101 intermediate the metal segment 2401 and the shank 2104. An insert 2402 may be bonded to the tapered region 3101, and a perimeter of the insert 2402 may be within 0.5 inches of the tapered region 3101. The inserts 2402 may extend beyond the perimeter 3110 of the tool 101. This may be beneficial in protecting the metal segment. A tool tip 3102 may be bonded to a cemented metal carbide, wherein the tip may comprise a layer selected from the group consisting of diamond, natural diamond, polycrystalline diamond, cubic boron nitride, infiltrated diamond, diamond impregnated carbide, diamond impregnated matrix, silicon bonded diamond, or combinations thereof. In some embodiments, a tip 3102 is formed by the first carbide segment. The first carbide segment may comprise a superhard material bonded to it although it is not required.

Figure 32:
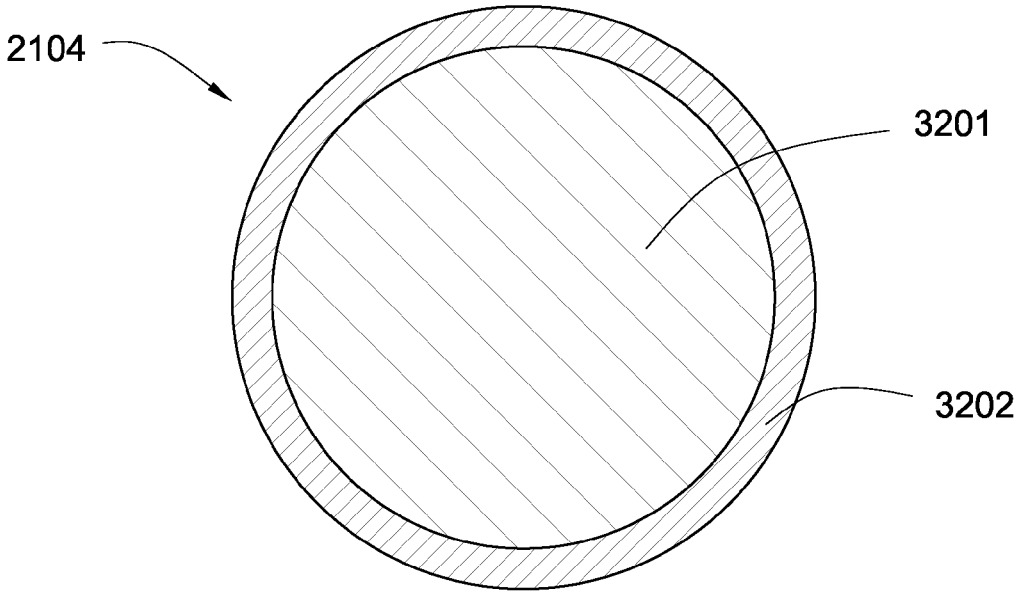
FIG. 32 is a cross-sectional diagram of an embodiment of a shank.
Figure 33:
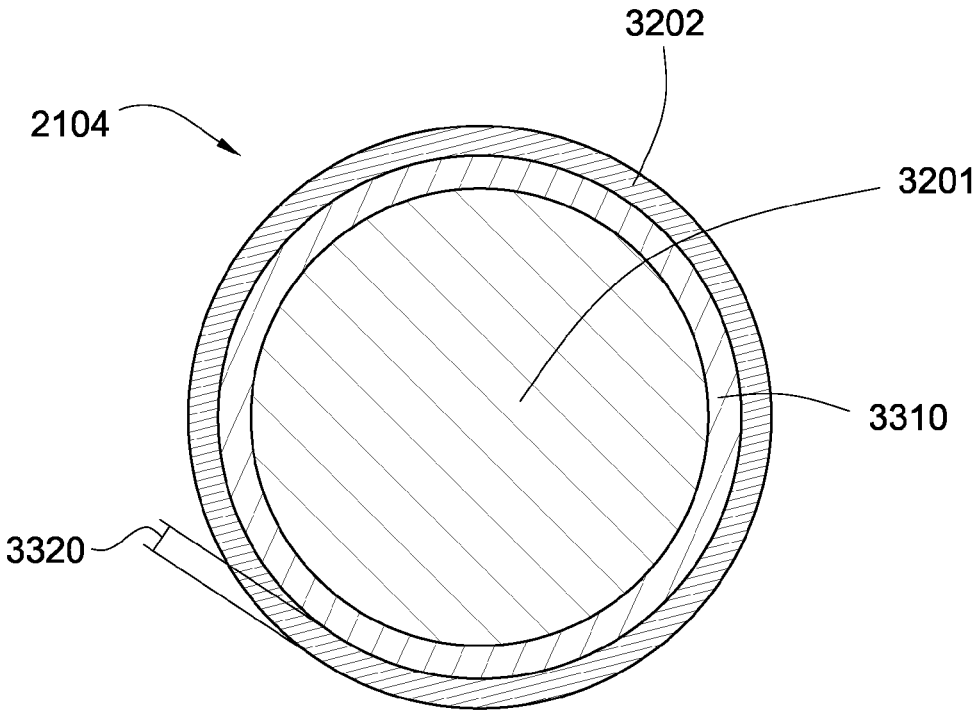
FIG. 33 is a cross-sectional diagram of another embodiment of a shank.

FIGS. 32 and 33 are cross-sectional diagrams of embodiments of the shank. An attack tool may comprise a wear-resistant base suitable for attachment to a driving mechanism, the wear-resistant base comprising a shank 2104 and a metal segment 2401; a cemented metal carbide segment bonded to the metal segment; and the shank comprising a wear-resistant surface 3202, wherein the wear-resistant surface 3202 comprises a hardness greater than 60 HRc.

The shank 2104 and the metal segment 2401 may be formed from a single piece of metal. The base may comprise steel having a hardness of 35 to 50 HRc. The shank 2104 may comprise a cemented metal carbide, steel, manganese, nickel, chromium, titanium, or combinations thereof. If a shank 2104 comprises a cemented metal carbide, the carbide may have a binder concentration of 4 to 35 weight percent. The binder may be cobalt.

The wear-resistant surface 3202 may comprise a cemented metal carbide, chromium, manganese, nickel, titanium, hard surfacing, diamond, cubic boron nitride, polycrystalline diamond, vapor deposited diamond, aluminum oxide, zircon, silicon carbide, whisker reinforced ceramics, diamond impregnated carbide, diamond impregnated matrix, silicon bonded diamond, or combinations thereof. The wear-resistant surface 3202 may be bonded to the shank 2104 though the processes of electroplating, cladding, electroless plating, thermal spraying, annealing, hard facing, applying high pressure, hot dipping, brazing, or combinations thereof. The surface 3202 may comprise a thickness 3220 of 0.001 to 0.200 inches. The surface 3202 may be polished. The shank 2104 may also comprise layers. A core 3201 may comprise steel, surrounded by a layer of another material, such as tungsten carbide. There may be one or more intermediate layers 3310 between the core 3201 and the wear-resistant surface 3202 that may help the wear-resistant surface 3202 bond to the core. The wear-resistant surface 3202 may also comprise a plurality of layers 3201, 3310, 3202. The plurality of layers may comprise different characteristics selected from the group consisting of hardness, modulus of elasticity, strength, thickness, grain size, metal concentration, weight, and combinations thereof. The wear-resistant surface 3202 may comprise chromium having a hardness of 65 to 75 HRc.

Figure 34:
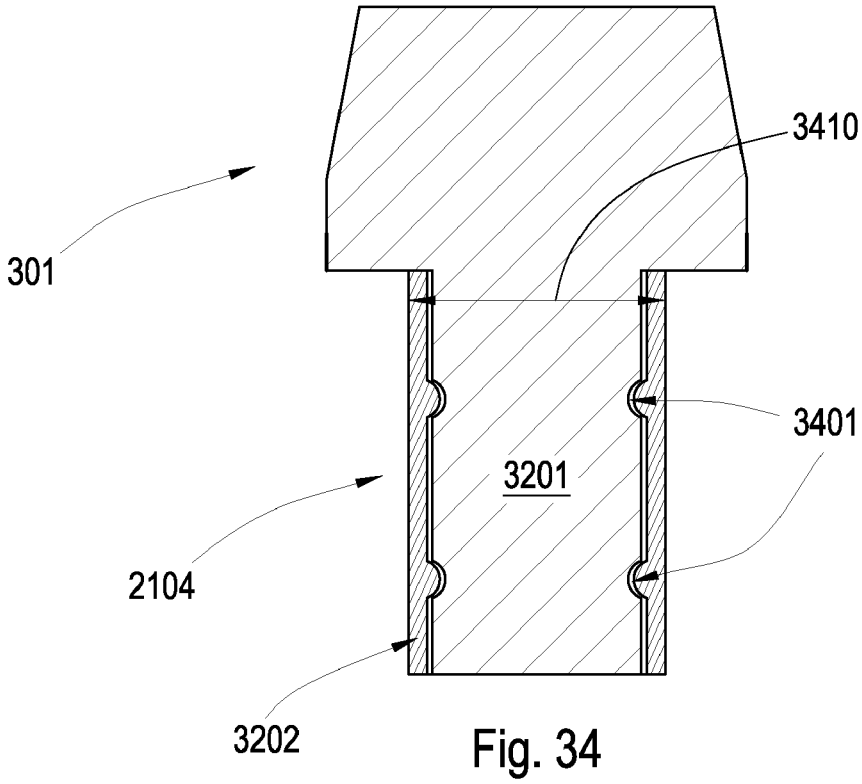
FIG. 34 is a cross-sectional diagram of an embodiment of a shank.
Figure 35:
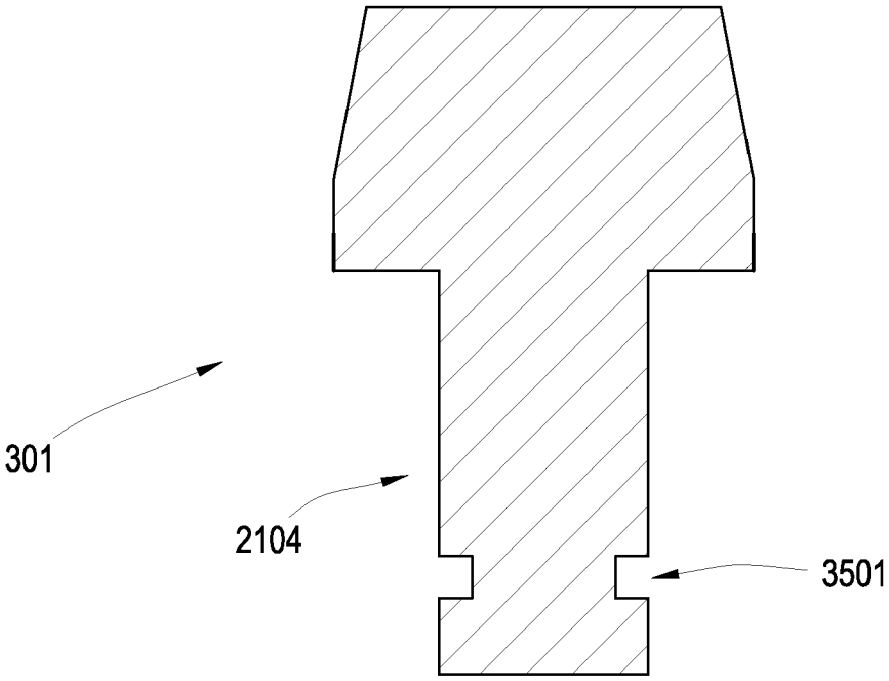
FIG. 35 is a cross-sectional diagram of another embodiment of a shank.

FIGS. 34 and 35 are orthogonal diagrams of embodiments of the shank. The shank 2401 may comprise one or more grooves 3401. The wear-resistant surface 3202 may be disposed within a groove 3401 formed in the shank 2104. Grooves 3401 may be beneficial in increasing the bond strength between the wear-resistant surface 3202 and the core 3201. The bond may also be improved by swaging the wear-resistant surface 3202 on the core 3201 of the shank 2104. Additionally, the wear-resistant surface 3202 may comprise a nonuniform diameter 3501. The nonuniform diameter 3501 may help hold a retaining member (not shown) while the tool 101 is in use. The entire cross-sectional thickness 3410 of the shank may be harder than 60 HRc. In some embodiments, the shank may be made of a solid cemented metal carbide, or other material comprising a hardness greater than 60 HRc.

Figure 36:
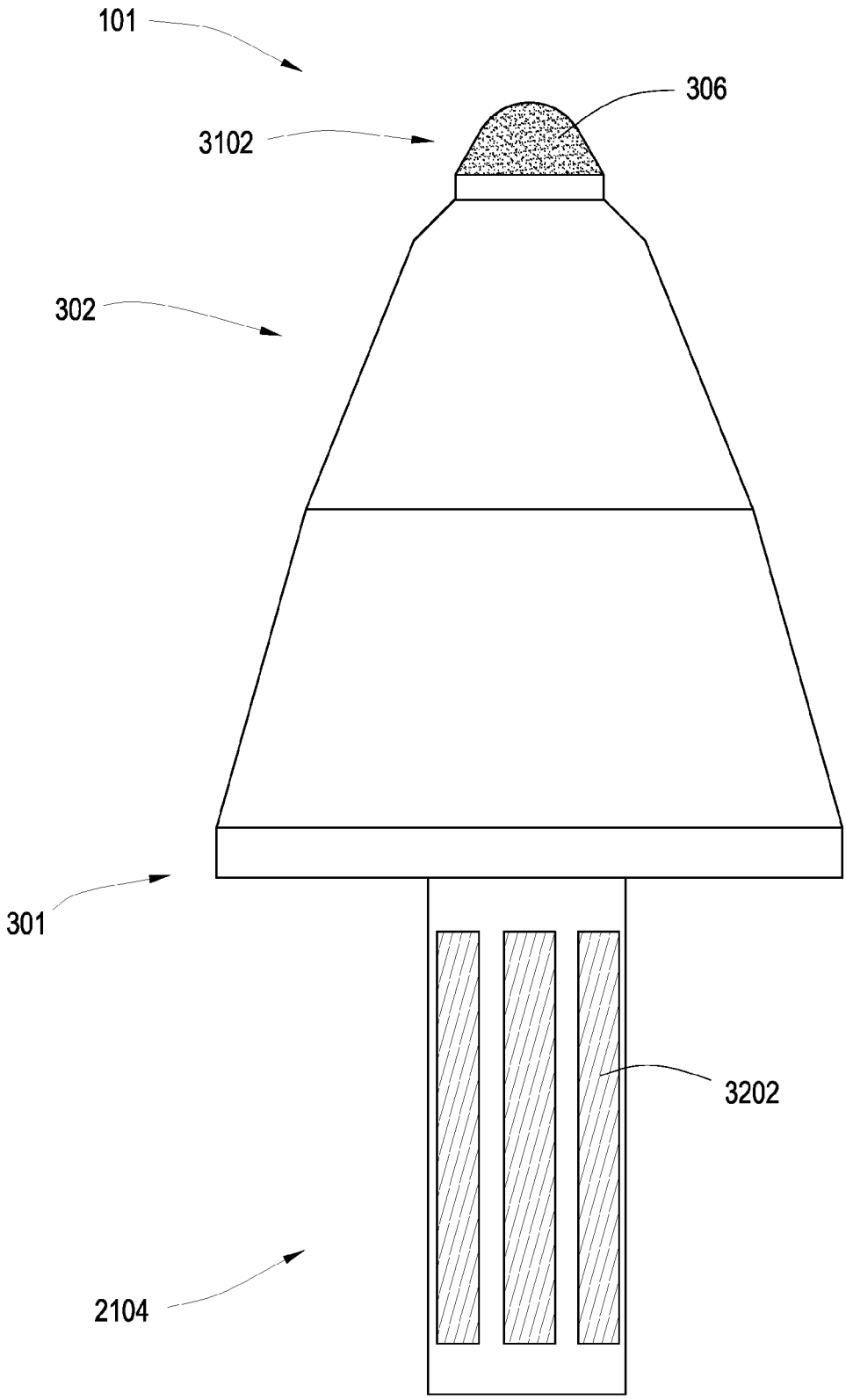
FIG. 36 is an orthogonal diagram of another embodiment of a shank.

FIG. 36 is an orthogonal diagram of another embodiment of the shank. The wear-resistant surface 3202 may be segmented. Wear-resistant surface 3202 segments may comprise a height less than the height of the shank 2104. The tool 101 may also comprise a tool tip 3102 which may be bonded to the cemented metal carbide segment 302 and may comprise a layer selected from the group consisting of diamond, natural diamond synthetic diamond, polycrystalline diamond, infiltrated diamond, cubic boron nitride, diamond impregnated carbide, diamond impregnated matrix, silicon bonded diamond, or combinations thereof. The polycrystalline diamond may comprise a binder concentration of 4 to 35 weight percent.

What is claimed is:

1. An attack tool, comprising:

a wear-resistant base suitable for attachment to a driving mechanism;

the wear-resistant base comprising a shank and a metal segment;

a portion of the shank being for insertion into a bore of a holder attached to the driving mechanism;

a cemented metal carbide segment bonded to the metal segment; and the portion of the shank being for insertion into the bore of the holder further comprising a wear-resistant surface having a hardness greater than 60 HRc.

2. The tool of claim 1, wherein the shank and the metal segment are formed from a single piece of metal.

3. The tool of claim 1, wherein the base comprises steel having a hardness of 35 to 55 HRc.

4. The tool of claim 1, wherein the shank comprises a cemented metal carbide, steel, manganese, nickel, chromium, titanium, or combinations thereof.

5. The tool of claim 1, wherein the shank comprises a cemented metal carbide with a binder concentration of 4 to 35 weight percent.

6. The tool of claim 5, wherein the binder is cobalt.

7. The tool of claim 1, wherein the wear-resistant surface comprises a cemented metal carbide, chromium, manganese, nickel, titanium, hard surfacing, diamond, cubic boron nitride, polycrystalline diamond, vapor deposited diamond, aluminum oxide, zircon, silicon carbide, whisker reinforced ceramics, diamond impregnated carbide, diamond impregnated matrix, silicon bonded diamond, or combinations thereof.

8. The tool of claim 1, wherein the wear-resistant surface is bonded to the shank.

9. The tool of claim 1, wherein the wear-resistant surface is segmented.

10. The tool of claim 1, wherein the wear-resistant surface is bonded to the shank by electroplating, cladding, electroless plating, thermal spraying, annealing, hard facing, applying high pressure, hot dipping, brazing or combinations thereof.

11. The tool of claim 1, wherein the wear resistant surface is polished.

12. The tool of claim 1, wherein a tool tip is bonded to the cemented metal carbide segment and comprises a material selected from the group consisting of diamond, natural diamond, synthetic diamond, polycrystalline diamond, infiltrated diamond, cubic boron nitride, thermally stable diamond, diamond impregnated carbide, diamond impregnated matrix, silicon bonded diamond, or combinations thereof.

13. The tool of claim 12, wherein the polycrystalline diamond comprises a binder concentration of 4 to 35 weight percent.

14. The tool of claim 12, wherein the material comprises at least two layers of polycrystalline diamond.

15. The tool of claim 1, wherein the wear resistant surface comprises a thickness of 0.001 to 0.200 inches.

16. The tool of claim 1, wherein the wear-resistant surface comprises a non-uniform diameter.

17. The tool of claim 1, wherein the wear-resistant surface is disposed within a groove formed in the shank.

18. The tool of claim 1, wherein an entire cross-sectional thickness of the shank is harder than 60 HRc.

19. The tool of claim 1, wherein the wear-resistant surface comprises a plurality of layers.

20. The tool of claim 19, wherein the plurality of layers comprise different characteristics selected from the group consisting of hardness, modulus of elasticity, strength, thickness, grain size, metal concentration, weight, and combinations thereof.

* * * * *